United States Patent [19]

Svatos

[11] Patent Number: 4,706,480

[45] Date of Patent: Nov. 17, 1987

[54] ROLLING MILL COOLING SYSTEM

[76] Inventor: Joseph D. Svatos, 1707 Windingridge Dr., Richmond, Va. 23229

[21] Appl. No.: 938,339

[22] Filed: Dec. 3, 1986

Related U.S. Application Data

[63] Continuation of Ser. No. 786,583, Oct. 11, 1985, abandoned.

[51] Int. Cl.[4] ..... B21B 37/12; B21B 27/10

[52] U.S. Cl. ..... 72/17; 72/201; 72/236

[58] Field of Search ..... 72/39, 40, 45, 201, 72/236, 8, 9, 10, 16, 17; 164/444; 266/113

[56] References Cited

U.S. PATENT DOCUMENTS 3,225,580 12/1965 El-Waziri ..... 72/236
4,256,168 3/1981 Hein et al. ..... 72/201 X
4,392,367 7/1983 Bald ..... 72/201 X
4,467,629 8/1984 Schimion ..... 72/201 X

FOREIGN PATENT DOCUMENTS 588923 2/1959 Italy ..... 72/201
55-86602 6/1980 Japan ..... 72/201

*Primary Examiner*—E. Michael Combs
*Attorney, Agent, or Firm*—John F. C. Glenn

[57] ABSTRACT

A metal rolling mill coolant spraying system for minimizing formation of tight edges of rolled strip. The system comprises supplemental assemblies for spraying the work rolls adjacent to the strip edges, mounted for lateral adjustment controlled in response to signals from a computer for initial setup or continuous operation based on shape meter roll edge rotor signal feedback.

12 Claims, 4 Drawing Figures

ROLLING MILL COOLING SYSTEM

This application is a continuation of application Ser. No. 786,583 filed Oct. 11, 1985, now abandoned.

BACKGROUND OF THE INVENTION

Metal strip, when deformed by rolling to reduce the thickness to a desired gauge, generates considerable heat, a portion of which is imparted into the work rolls performing the work. It is necessary that heat in the work rolls be controlled to a proper level to allow thermal shaping of the rolls, but not to an excessive amount where thermal instability occurs.

Typically a rolling mill is equipped with a coolant spray system which has a top work roll spray bar and a bottom work roll spray bar, as well as top and bottom back-up roll spray bars where back-up rolls are utilized. Each spray bar is a fixed header, often with some latitude for angular adjustment while out of operation, and is equipped with spray valves having nozzles directed to a fixed portion of the roll. Spray patterns are normally fixed, with coolant flow controlled by manually or solenoid operated valves. The area of impingement of each spray on the work roll is typically about 2 inches to 4 inches wide along the length of the work roll. In the case of the back-up roll spray bars, this zone width is adequate since the back-up roll spray bars, this zone width is adequate since the back-up rolls have less effect on strip shape than the work rolls. In the case of the work rolls, "tight edges" occur in the strip if the rolls in the areas at the edges of the strip are under cooled or over cooled relative to the remainder of the roll surface in contact with the strip. "Tight edges" refer to thickened strip margins and are caused by a temperature gradient that exists across the area of the work roll surface inboard the edge of the strip, where the roll is relatively hot, to that outboard the edge of the strip, where the roll is relatively cool. It is desirable to roll metal which is free of tight edges to improve shape and to allow faster rolling speeds. Adjustment of the coolant volume of the spray valves is inadequate for this purpose and hence there has been a long standing need for a method of preventing tight edges from occurring.

SUMMARY OF THE INVENTION

The present invention provides a mobile spray system for cooling the work roll surfaces in the area of the edges of the strip so precisely as to eliminate the condition that causes tight edges. This is preferably installed to operate in conjunction with standard spray systems. All sprays of the standard system that impinge fully on the roll surface in the area where the strip is being rolled are actuated as usual, either manually or automatically with an automatic shape control system. Those valves that would spray the area of the work rolls beyond the edges of the strip are turned off, and any resulting gaps between the edges of the strip and the conventional sprays are cooled by mobile sprayers of the present invention. Conventional fixed sprays are used to cool most of the work roll surfaces contacting the metal, and the mobile spray assemblies are moved to extend the spray pattern up to the edge of the strip whenever there is a gap between the conventional spray pattern and a strip edge.

As rolling commences, positioning of the present invention sprays is achieved either manually, or if automatic shape control is present, the automation is used to provide continuous correction as required to eliminate tight edges. The automatic correction can be achieved by any of a number of methods. The method that is most reliable involves using a closed loop system sensing the loading on a shape meter rotor against a strip edge, and using a computer program to analyze the rotor signal and make the required response through proper operation of the movable sprayers of the present invention.

BRIEF DESCRIPTION OF THE DRAWING

The accompanying drawings show schematically the present preferred embodiment of a spray system applied to a rolling mill to eliminate the formation of tight edges, wherein.

DESCRIPTION OF ILLUSTRATED EMBODIMENT

Referring now more particularly to the accompanying drawings, a strip 10 is shown being rolled between a pair of work rolls 12*a* and *b* mounted between back-up rolls 14*a* and *b*.

Coolant for the rolls is supplied on the entry side of the rolls, through sprayers arranged in rows extending adjacent to the respective rolls and in a direction parallel to the roll axes. A pair of conventional sprayer bars respectively comprising fixed sprayer units 16*a* and *b* cool the respective back-up rolls 14*a* and *b*. The work rolls are cooled by conventional fixed sprayers and by supplemental moveable sprayers in accordance with the invention. Two spray bars of fixed sprayer units 18*a* and *b* extend along the length of the respective work rolls, 12*a* and *b*, one adjacent to each roll. The supplemental sprayers are in four sets 20*a'*, *a''*, *b'* and *b''*, one for each end of each work roll, each set being moveable from one end of the adjacent work roll surface toward the center of its length.

The spray bars 18*a* and *b* each have a series of fixed sprayer units arranged side by side along the length of the adjacent work roll surface. Each of these sprayer units has multiple nozzles 22*a*, *b* and *c* arranged one above the other and is supplied with coolant fluid from a coolant chamber 24 for the spray bar containing the unit. Each of the nozzles 22*a*, *b* and *c* is individually controlled by a corresponding series of on and off valves 23, which in turn are individually controllable to adjust the relative amounts of coolant from successive sprayer units along each of the spray bars 18*a* and *b*. Each of the nozzles 22*a*, *b* and *c* is set to spray at a rate differing from the other two (such as 1, 2 and 4 gallons per minute from the respective nozzles 22*a*, *b* and *c*).

Figure 4:
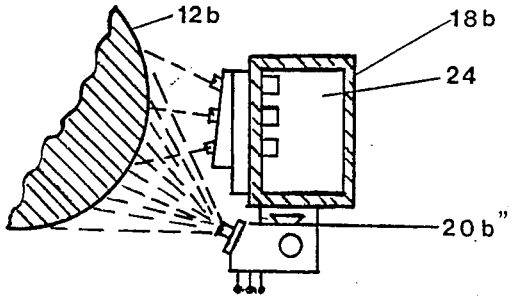
FIG. 4 shows an enlarged sectional view of a portion of the bottom supplemental spray means on the opposite side of the mill from that shown in FIGS. 1–3 (sectioned on line 4—4 in FIG. 2).

This is conventional practice for providing a considerable range of adjustment of the fixed sprayers against most of the area of contact of the work rolls with a strip going through the mill, while shutting off the spray beyond the side edges of the strip. As is also conventional, the sprays from nozzles 22*a, b* and *c* are fanned out in separate flat planes which strike the adjacent work roll in separate lines extending almost parallel to the axis of the roll. The divergence from parallel minimizes interference between adjacent edges of corresponding sprays from two side by side fixed nozzle sprayer units; for example, see sprays 26 from nozzles 22*a, b* and *c* in FIGS. 2, 3 and 4.

Figure 1:
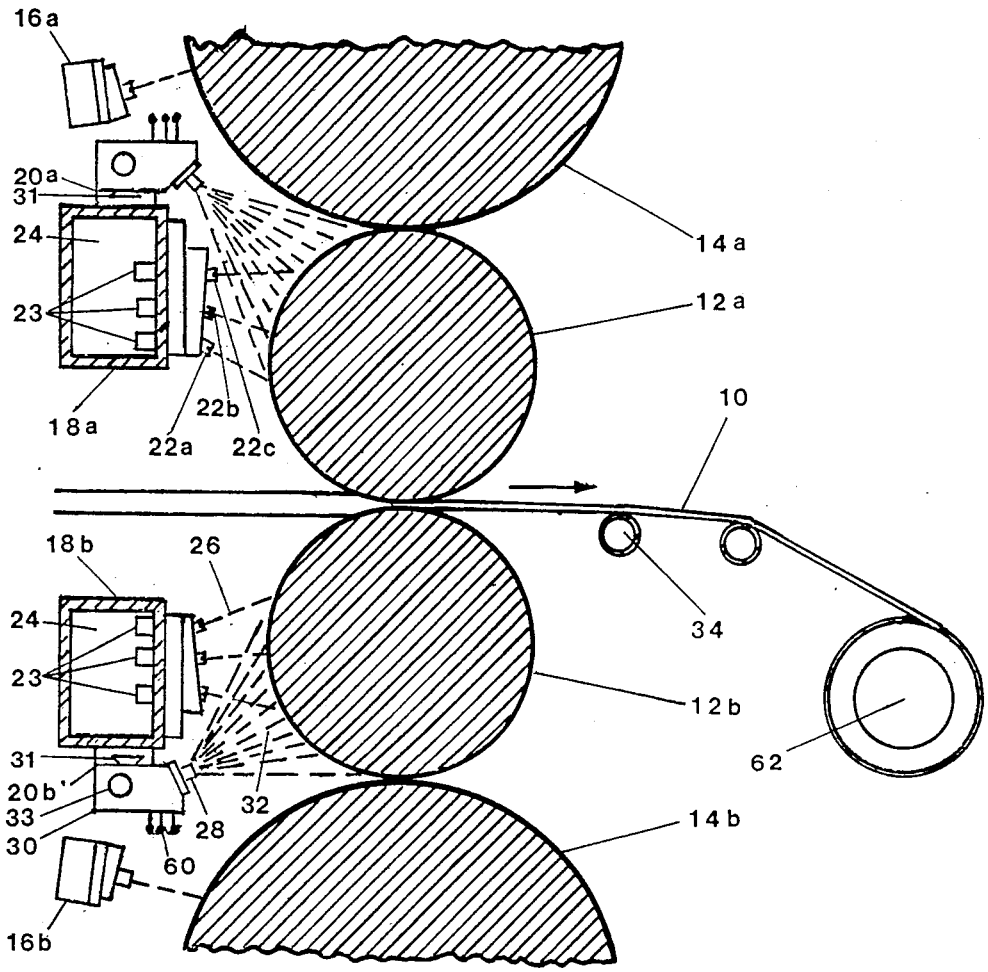
FIG. 1 shows a fragmentary cross section view of a 4-high rolling mill incorporating a type of conventional cooling headers and supplemental spray means in accordance with the present invention (sectioned on line 1—1 FIG. 2)
Figure 2:
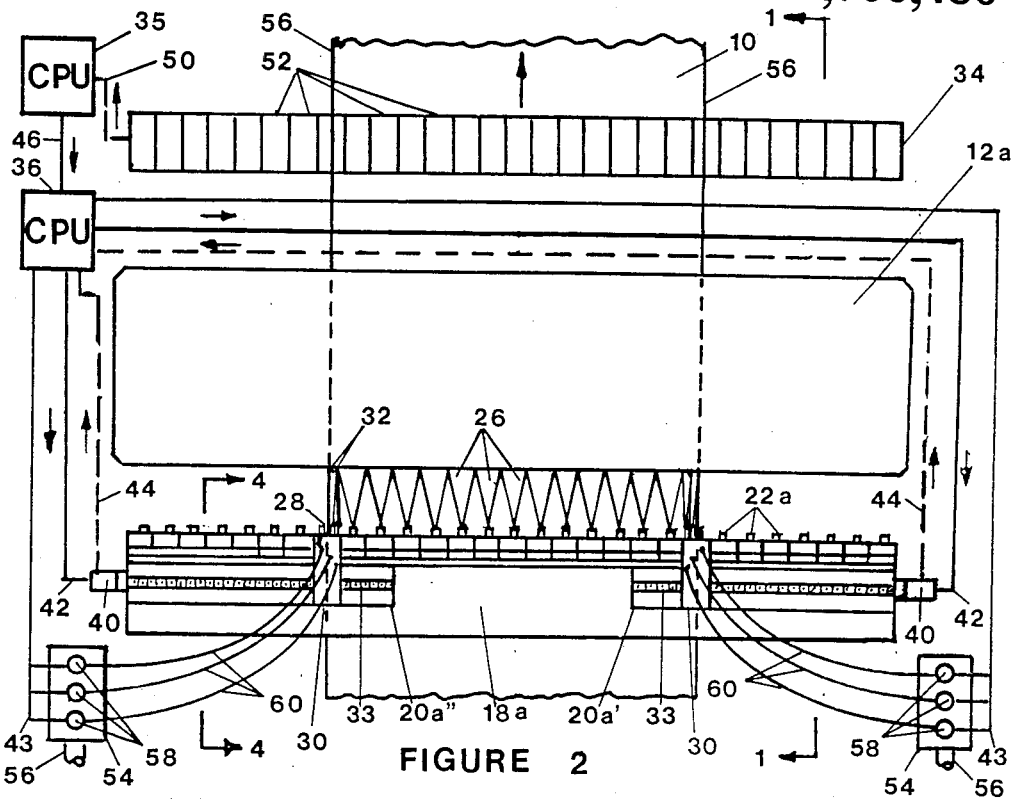
FIG. 2 shows a plan view of the roll stack shown in FIG. 1, viewed from the top of the mill with the top back-up roll and top back-up coolant header removed, revealing the location of two sets of the supplemental spray means in the mill relative to the strip and the conventional work roll spray header.
Figure 3:
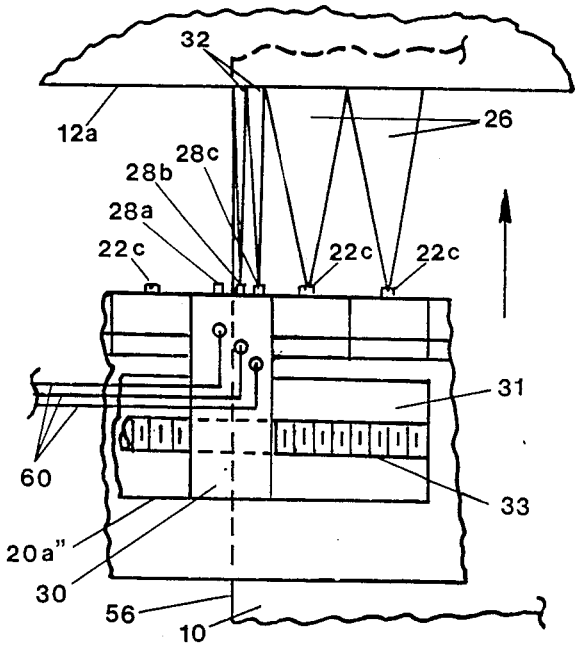
FIG. 3 shows an enlargement of a portion of the spray systems at the left edge of the strip shown in FIG. 2.

The moveable sets of sprayers 20*a'*, *a''*, *b'* and *b''* each has a single row of nozzles 28*a, b* and *c* mounted side by side on a common moveable sub-base 30, and extending in a row parallel to the axis of the adjacent work roll. Each sub-base 30 is laterally traversed by a mechanism such as a sliding dovetail base 31 and screw 33 for endwise movement parallel to the axis of the adjacent work roll outwardly from the center of the roll surface and up to one of its ends. These nozzles each project a spray 32 which fans out between and generally parallel to two planes normal to the roll axes, so that (as shown in FIG. 1) it strikes a relatively wide arc (such as 20 to 40 degrees) around the adjacent work roll, considered apart from rotational effects, but (as shown in FIG. 2) strikes a narrower lengthwise portion of the adjacent work roll surface than is struck by each spray from the fixed sprayers 18*a* and *b*. The degree of narrowness depends on how many nozzles are used in each of the moveable sprayers. It is desirable for the sum of the width of the sprays 31 along the length of the adjacent work roll to be a little less than the width on the roll of sprays from each fixed sprayer 18*a* and *b*. For example, the width of bands around the opposite work roll surface wet by each of the three nozzles 28*a, b* and *c* is perferably about ¼ of the width of the band wet by spray from each set of fixed nozzles 22*a, b* and *c*. Consequently, if the width of a strip being rolled in the mill exactly fits the combined spray width of a certain number of sprayers, none of the moveable nozzles 28*a, b* and *c* are turned on. If the strip width does not exactly fit the combined width of sprays from fixed sprayers, the largest number of fixed sprayers is used which will fit within the strip width, and the difference up to the edge of the strip is filled with sprays 32 from one or more of the nozzles 28*a, b* and *c* (for example, as shown in FIGS. 2 and 3). This is accomplished by turning on as many of the nozzles 28*a, b* and *c* as are needed in each of the moveable sprayers 20*a'*, *a''*, *b'* and *b''* and adjusting their positions by moving each of the rows endwise to put the outermost spray 32 up to but not beyond the adjacent strip edge.

Each of the moveable sets of sprayers 20*a'*, *a''*, *b'* and *b''* is supplied with coolant from its own coolant valve stand 54 which is connected to the mill coolant supply pipe 56. Each valve stand 54 typically has electrically operated solenoid valves 58, one for each of the nozzles 28*a, b*, and *c* of the moveable sprayer supplied by that valve stand. A flexible hose 60 connects one of the valves 58 to one of the nozzles 28*a, b* and *c*.

The positions and operations of the moveable sets of sprayers 20*a'*, *a''*, *b'* and *b''* and the respective nozzles 28*a, b* and *c* of each of them are preferably controlled automatically through a conventional shapemeter roll 34 and a pair of central processing units, CPU 35 and 36. Each set of moveable nozzles 28*a, b* and *c* is moveable along its sliding dovetail support 31 by a screw 33 operated by a motor 40. Each of the four motors 40 controlling the position of the four sets of nozzles 28*a, b* and *c* has electrical lines 42 and 44 connecting it to CPU 36. Each line 42 transmits control signals from CPU 36 to the connected motor 40 causing the motor to operate screw 33 to move one of the sets of nozzles 28*a, b* and *c* toward or away from the nearest end of the adjacent work roll, or to stop such movement. Lines 44 send feedback signals to CPU 36, indicating the current position of the connected nozzles. Lines 43 connect CPU 36 to the respective valves 58 controlling each of the nozzles 28*a, b* and *c* to open or close. CPU 36 is in turn connected by line 46 to a conventional shape control system CPU 35 which receives signals through line 50 from a series of rotors 52 along the length of shapemeter roll 34. The line 46 conveys rotor signals from CPU 35 to the CPU 36 indicating the level of tension in a strip 10 as sensed by the respective rotors.

Substantial tension is conventionally applied to strip emerging from a rolling mill by a take up reel 62 or by a tandem mill stand, and the tension distribution across the strip is evaluated by CPU 36 by comparing the signals from rotors 52. As nearly as can be arranged, each spray 26 from one set of fixed nozzles 22*a, b* and *c* covers a portion of a work roll against a part of the strip width which extends across one of the rotors 52, and hence the tension on that rotor can be adjusted by adjusting flow from that set of nozzles until the desired level of tension has been achieved. On the other hand, each spray 32 from moveable nozzles 28*a, b* and *c* covers a narrower portion of a work roll against a narrower part of the strip going to a minor part of the width of one of the rotors 52. What CPU 36 must do, therefore, is to cause each set of moveable nozzles 28*a, b* and *c* to activate one or more of their sprays 32 and to fill the gap between the adjacent strip edge and the nearest edge of a spray 26 from the fixed nozzles, and adjust the position of the moveable sprayers 20*a'*, *a''*, *b'* and *b''* until the vertical side of the spray 32 nearest to the strip edge is up to and not beyond the strip edge (for example, see the two sprays 32 from nozzles 28*b* and *c* extending up to strip edge 56 in FIGS. 2 and 3). In order to do this, CPU 36 is programmed to determine which rotor 52 is against a strip edge, what proportion of the rotor engages the strip, how the tension reading of that rotor should be modified to take into account that proportion for purposes of comparison with the other rotor readings, and to intermittently re-position and selectively control activation of each set of nozzles 28*a, b* and *c* to achieve a more effective cooling of the roll portion against that part of the strip which bears on said rotor, until the desired evenness of the strip edge tension with the average tension across the strip has been achieved. This control through CPU 36 applies separately to each of the four sets of moveable nozzles 28*a, b* and *c* above and below the strip at each end of the work rolls.

The use of the moveable sprayers of the invention is applicable to rolling aluminum, steel and other metals of comparable rolling characteristics, and is especially helpful in overcoming tight edges when rolling at high speeds, such a 6000 feet per minute.

While present preferred means and methods of practicing the invention have been illustrated and described, it will be understood that it may otherwise be variously practiced and embodied within the scope of the following claims.

What is claimed is:

1. A strip rolling mill comprising a pair of cooperating work rolls having parallel axes, spray means for cooling each work roll comprising a row of side-by-side sets of nozzles directed to spray directly against the adjacent roll, means mounting said sets of nozzles in fixed positions, the nozzles in each row being adjusted to spray side-by-side fixed portions of most of the length of the adjacent roll, means to selectively activate the nozzles in each row to adjust their combined spray width and thereby approximate but not exceed the varying widths of successive strips to be rolled in the mill, and means to improve said approximation comprising additional sets of other nozzles, each additional set being near and offset from a side of a row of said fixed sets of nozzles, and each being adjusted to spray directly against the same roll sprayed by the nearby side of a row of fixed set of nozzles and to spray against a narrower portion of the length of the same roll than any portion of said roll sprayed by any of the fixed nozzle sets which are nearby in the path of movement of the additional nozzle set, means mounting each additional nozzle set to move laterally substantially parallel to said roll axes and in offset relation to and along at least the outer part of the adjacent side of a row of fixed nozzle sets directed at the same roll, and means operable to so laterally move each of said additional nozzle sets and thereby enable them to be moved to spray the outermost portions of the roll in contact with the strip when the widest selection of the fixed nozzles within the strip width is less than the strip width.

2. A strip rolling mill according to claim 1, in which said power means comprises a plurality of independently operable power means each connected to move one of said sets of nozzles.

3. A strip rolling mill according to claim 2, comprising a central control system connected to operate the independently operable power means for said sets of nozzles.

4. A rolling mill according to claim 1, in which each of said sets of nozzles means is mounted for lateral movement independently of the other sets of the same pair of sets.

5. A rolling mill according to claim 1, in which said nozzles comprise nozzles which are not included in said sets of nozzles and are not laterally movable while spraying during rolling in the mill.

6. A rolling mill according to claim 1, in which each nozzle of each set of nozzle means is constructed and arranged to project a spray which fans out between and extends generally parallel to a pair of planes normal to the roll axes.

7. A strip rolling mill according to claim 1, in which each said additional set of nozzles is mounted for lateral movement to shift the spray therefrom along a minor portion of half the length of the adjacent roll, said minor portion extending from adjacent one end of the roll toward its other end.

8. A strip rolling mill according to claim 1, in which said means to laterally move each said additional set of nozzles is operable while spraying during rolling in the mill.

9. A strip rolling mill comprising a pair of work rolls, fixed nozzles adjacent to and arranged lengthwise of the respective work rolls, each fixed nozzle being positioned to project a spray directly against a limited length of the adjacent work roll, and means to control flow through each fixed nozzle and thereby adjust the combined width of spray from the fixed nozzles in increments equal to their individual widths of spray, moveable nozzles adjacent to the respective work rolls, each moveable nozzle while not moving having a spray width on the adjacent roll which is substantially less than the individual widths of spray from the fixed nozzles, a plurality of means each mounting a moveable nozzle for movement adjacent to and along a portion of the length of one of said rolls between its center and one of its ends, each of said roll portions being sprayable by at least one of said moveable nozzles in the course of its movement, and power means connected to each of said moveable nozzles for laterally shifting the moveable nozzles during rolling to effect spraying of the rolls up to a side edge of a strip passing between the rolls when the edge is beyond the combined widths of spray from the fixed nozzles.

10. A strip rolling mill in accordance with claim 9, in which a plurality of said moveable nozzles are mounted on each of said moveable mounting means and are provided with adjustment means to direct their sprays to wet side-by-side bands around the adjacent roll as it rotates.

11. A rolling mill according to claim 10, in which said fixed nozzles are each constructed and arranged to project individual sprays on the adjacent roll which are each wider than the combined width of said side-by-side bands of spray on the same roll from the nozzles mounted on any one of said moveable mounting means.

12. A strip rolling mill comprising a pair of work rolls, fixed nozzles adjacent to and arranged lengthwise of the respective work rolls, each fixed nozzle being positioned to project a spray directly against a limited length of the adjacent work roll, and means to control flow through each fixed nozzle and thereby adjust the combined width of spray from the fixed nozzles in increments substantially equal to their individual widths of spray, moveable nozzles adjacent to the respective work rolls, each moveable nozzle while not moving having a spray width on the adjacent roll which is substantially less than the individual width of spray from the fixed nozzles, a plurality of means each mounting a moveable nozzle for movement adjacent to and along a portion of the length one of said rolls between its center and one of its ends, each of said portions of said rolls being sprayable by at least one of said moveable nozzles, whereby the moveable nozzles are moveable to spray the rolls up to a side edge of a strip passing between the rolls when the edge is beyond the combined widths of spray from the fixed nozzles, means to sense differences in tension across a strip emerging from the mill, means to determine from response of said sensing means whether a marginal portion of the emerging strip is rolled between improperly cooled portions of the rolls, and means responsive to said determining means to move a nozzle to spray said portion of an adjacent roll.

* * * * *